US005424499A

United States Patent [19]

Orr

[11] Patent Number: 5,424,499

[45] Date of Patent: Jun. 13, 1995

[54] CONTROL DEVICE AND METHOD OF MAKING THE SAME

[75] Inventor: Kenneth J. Orr, Caledonia, Mich.

[73] Assignee: Robertshaw Controls Company, Richmond, Va.

[21] Appl. No.: 279,942

[22] Filed: Jul. 25, 1994

Related U.S. Application Data

[63] Continuation of Ser. No. 4,725, Jan. 14, 1993.

[51] Int. Cl.[6] ..... H01H 19/00

[52] U.S. Cl. ..... 200/11 R; 200/11 DA

[58] Field of Search ..... 200/6 R, 6 A, 11 R, 200/11 A, 11 D, 11 DA, 11 E, 11 G, 11 H, 11 J, 11 K, 11 TC, 11 TW, 17 R, 564, 567, 336; 361/760, 781, 784, 802, 807, 809, 810, 832

[56] References Cited

U.S. PATENT DOCUMENTS 3,511,956 5/1970 Fields ..... 200/172

4,038,504 7/1977 McAnulty et al. ..... 200/11 DA 5,086,200 2/1992 Kline et al. ..... 200/571

*Primary Examiner*—A. D. Pellinen

*Assistant Examiner*—Michael A. Friedhofer

*Attorney, Agent, or Firm*—Candor, Candor & Tassone

[57] ABSTRACT

A control device and method of making the same are provided, the control device comprising a rotary switch carried on the component mounting side of a printed circuit board of the control device and having opposed sides with a central opening passing through the opposed sides thereof, and an actuator shaft having a portion thereof disposed in the central opening for operating the rotary switch upon rotation of the shaft, the shaft having structure snap fitting the portion thereof in the central opening of the rotary switch when the portion of the shaft is initially inserted into the central opening by being axially moved from the solder side of the board to the component mounting side of the board.

18 Claims, 3 Drawing Sheets

CONTROL DEVICE AND METHOD OF MAKING THE SAME

CROSS REFERENCE TO RELATED APPLICATIONS

This application is a continuation patent application of its copending parent patent application, Ser. No. 004,725, filed Jan. 14, 1993.

BACKGROUND OF THE INVENTION

1. Field of the Invention

This invention relates to a new control unit, such as a clock and/or a timer, as well as to a new method of making such a control device.

2. Prior Art Statement

It is known to provide a control device comprising a printed circuit board having opposed sides one of which comprises a solder side thereof and the other of which comprises a component mounting side thereof, a rotary switch means carried on said component mounting side of said board and having opposed sides with a central opening passing through the opposed sides thereof, and an actuator shaft having a portion thereof disposed in said central opening for operating the rotary switch means upon rotation of the shaft, the shaft having means snap fitting the portion thereof in the central opening of the rotary switch means when the portion of the shaft is initially inserted into the central opening by being axially moved from the adjacent component mounting side of the board into the central opening of the rotary switch means and toward the component mounting side of the board.

SUMMARY OF THE INVENTION

It is one of the features of this invention to provide a new control device wherein unique means are provided for interconnecting an actuator shaft to a rotary switch means that has been mounted to the component mounting side of a printed circuit board.

In particular, it was found according to the teachings of this invention that when making a control device so that the solder side of the printed circuit board is facing the inside surface of a cover means of the control device, a rotary switch can be mounted on the component side of the printed circuit board and the actuator means can be so constructed and arranged that the same can be inserted through an opening formed through the printed circuit board from the solder side thereof to the component mounting side thereof and be received in the central opening of the rotary switch means to be snap fitted therein.

For example, one embodiment of this invention comprises a control device comprising a printed circuit board having opposed sides one of which comprises a component mounting side thereof, a rotary switch means carried on the component mounting side of the board and having opposed sides with a central opening passing through the opposed sides thereof, and an actuator shaft having a portion thereof disposed in the central opening for operating the rotary switch means upon rotation of the shaft, the shaft having means snap fitting the portion thereof in the central opening of the rotary switch means when the portion of the shaft is initially inserted into the central opening by being axially moved from the solder side of the board to the component mounting side of the board.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
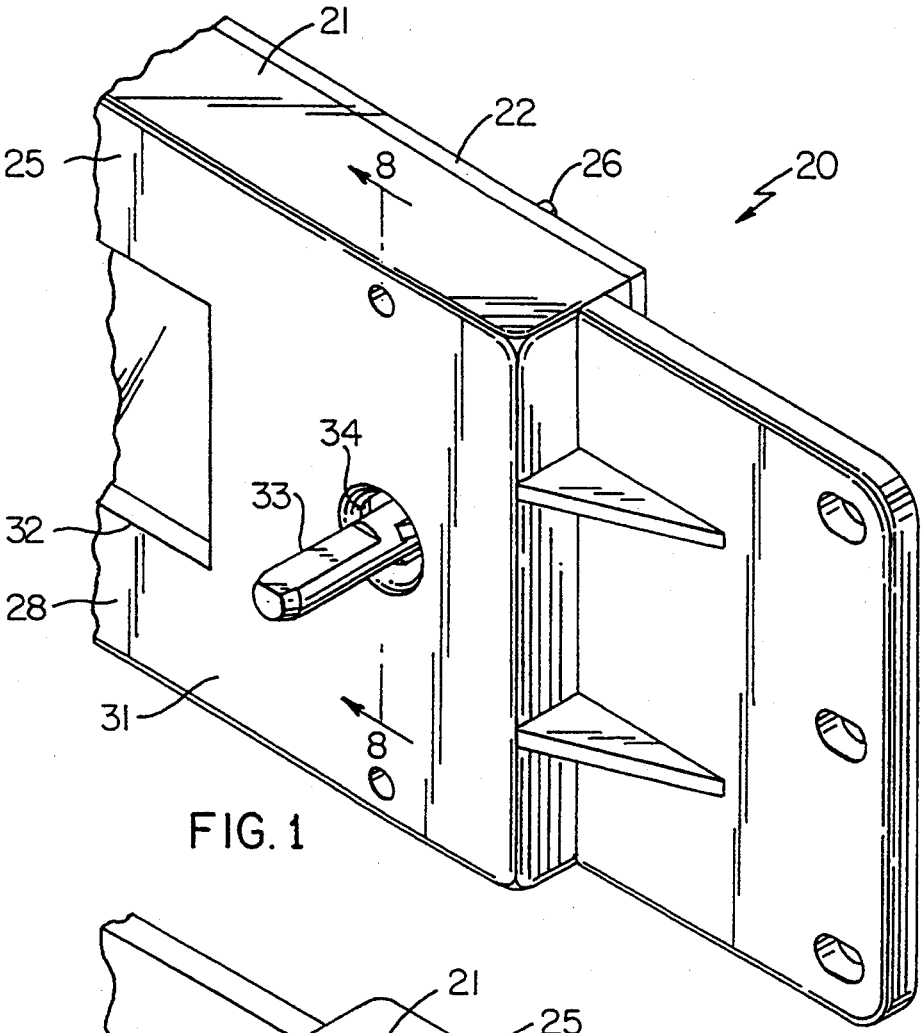
FIG. 1 is a fragmentary perspective view illustrating the new control device of this invention.
Figure 2:
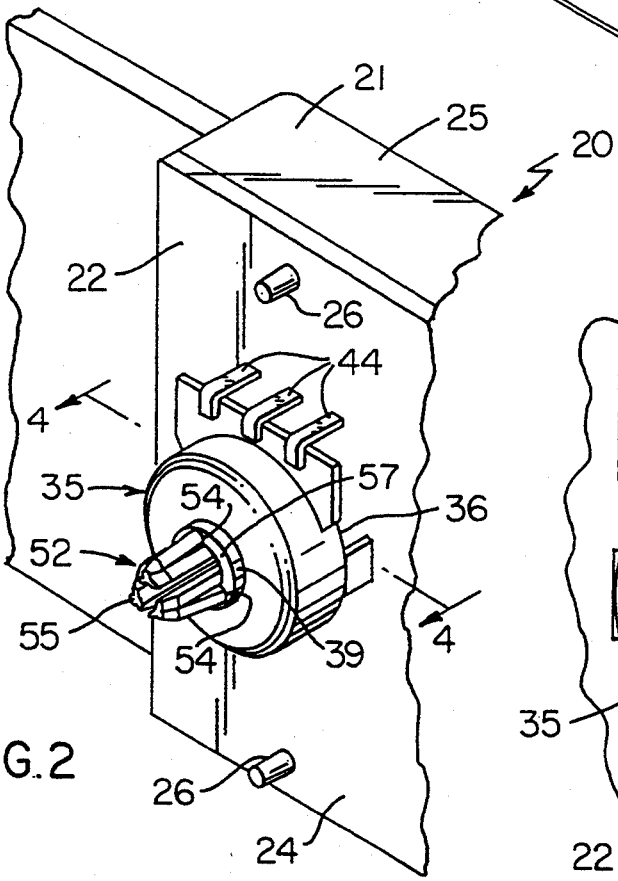
FIG. 2 is a fragmentary perspective view of the rear side of the portion of the control device illustrated in FIG. 1.

While the various features of this invention are hereinafter illustrated and described as being particularly adapted to provide a control device having a clock and/or a timer, it is to be understood that the various features of this invention can be utilized singly or in various combinations thereof to provide a control device for controlling other functions as desired.

Therefore, this invention is not to be limited to only the embodiment illustrated in the drawings, because the drawings are merely utilized to illustrate one of the wide variety of uses of this invention.

Referring now to FIGS. 1–8, the new control device of this invention is generally indicated by the reference numeral 20 and comprises a support means 21, the support means 21 comprising a printed circuit board 22 having a substantially flat printed circuit and solder side 23 and an opposed substantially flat component mounting side 24 and a cover means 25 carried by the board 22 by having a plurality of posts 26 passing through openings 27 formed through the board 22 and being secured therein in any suitable manner, such as by adhesive means or the like.

In this manner, the cover means 25 has a front plate or part 28 with its inner side 29 spaced from the solder side 24 of the board 22 and cooperating therewith to define a cavity or chamber 30 therebetween, the outer surface 31 of the front plate or part 28 having a window 32 therein for exposing a vacuum fluorescent display unit or the like to indicate time of day, a timer setting etc. depending upon the function of the control device 20.

In one working embodiment of the control device 20 of this invention, the same has an actuator shaft 33 extending out of an opening 34 in the front part 29 of the cover means 25 and has a suitable knob (not shown) disposed thereon for rotating the shaft 33, the shaft 33 when rotated in one direction incrementing upwardly the time indicated in the window 32 and when rotated in the other direction incrementally decreasing the time indicated in the window whereby the shaft 33 can adjust the time setting or time period being monitored by the device 20 for reasons well known in the art.

Figure 3:
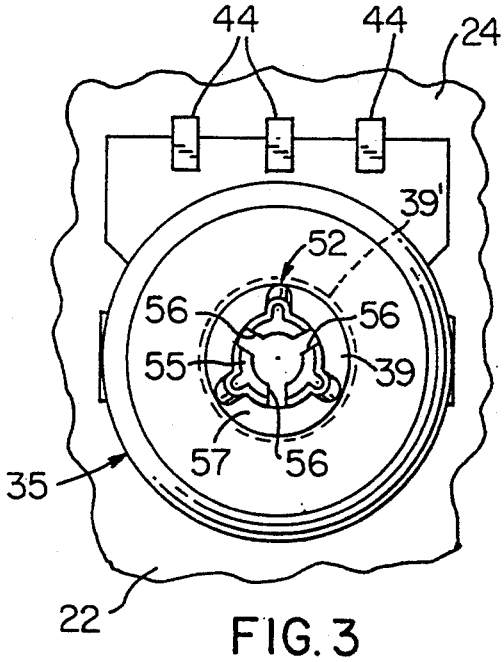
FIG. 3 is an enlarged view looking at the rotary switch means of the control device of FIG. 2 and illustrates the rotatable switch therein by a dashed line.

The rotatable actuator shaft 33 controls a rotary switch means that is generally indicated by the reference numeral 35 and has opposed sides 36 and 37 and a central opening 38 passing through a rotatable actuator 39 of the rotary switch means 35 whereby rotation of the actuator 39 causes like rotation of a switch means 39', FIG. 3, in the rotary switch 35 to perform its switching function in a manner well known in the art.

While any type of rotary switch can be utilized as the same are well known in the art, see the U.S. Pat. No. 4,777,483, to Fowler, as one typical example of a rotary switch that increments the time in an increasing manner when the switch means thereof is rotated in one direction and in a decreasing manner when rotated in the opposite direction whereby this U.S. patent is being incorporated into this disclosure by this reference thereto.

Figure 5:
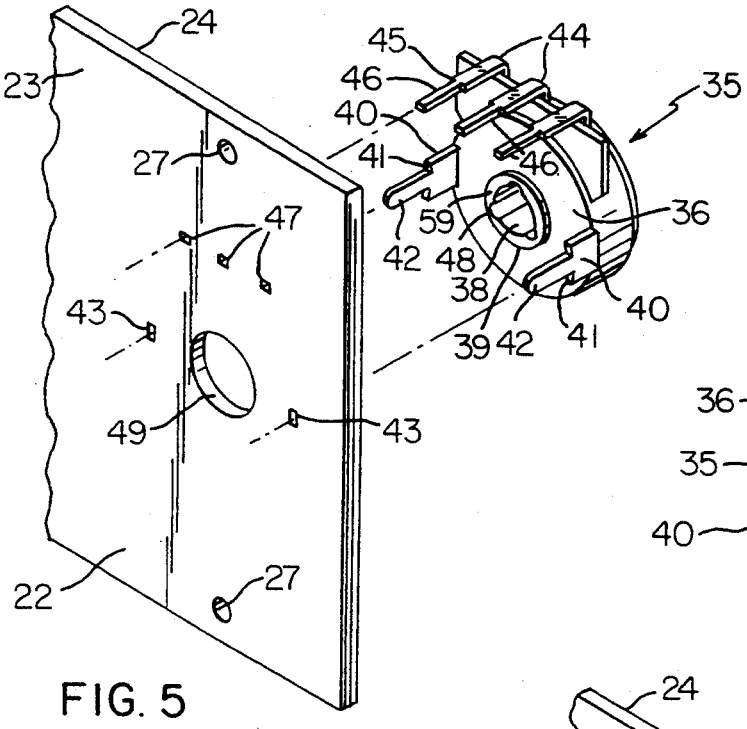
FIG. 5 is an exploded fragmentary perspective view illustrating how the rotary switch means is to be mounted to the circuit board means of the control device.
Figure 4:
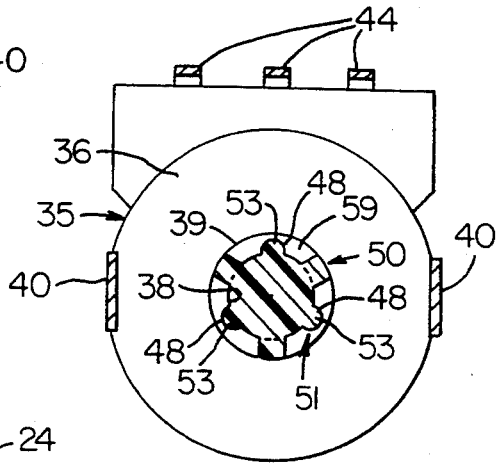
FIG. 4 is an enlarged cross-sectional view taken on line 4—4 of FIG. 2.
Figure 6:
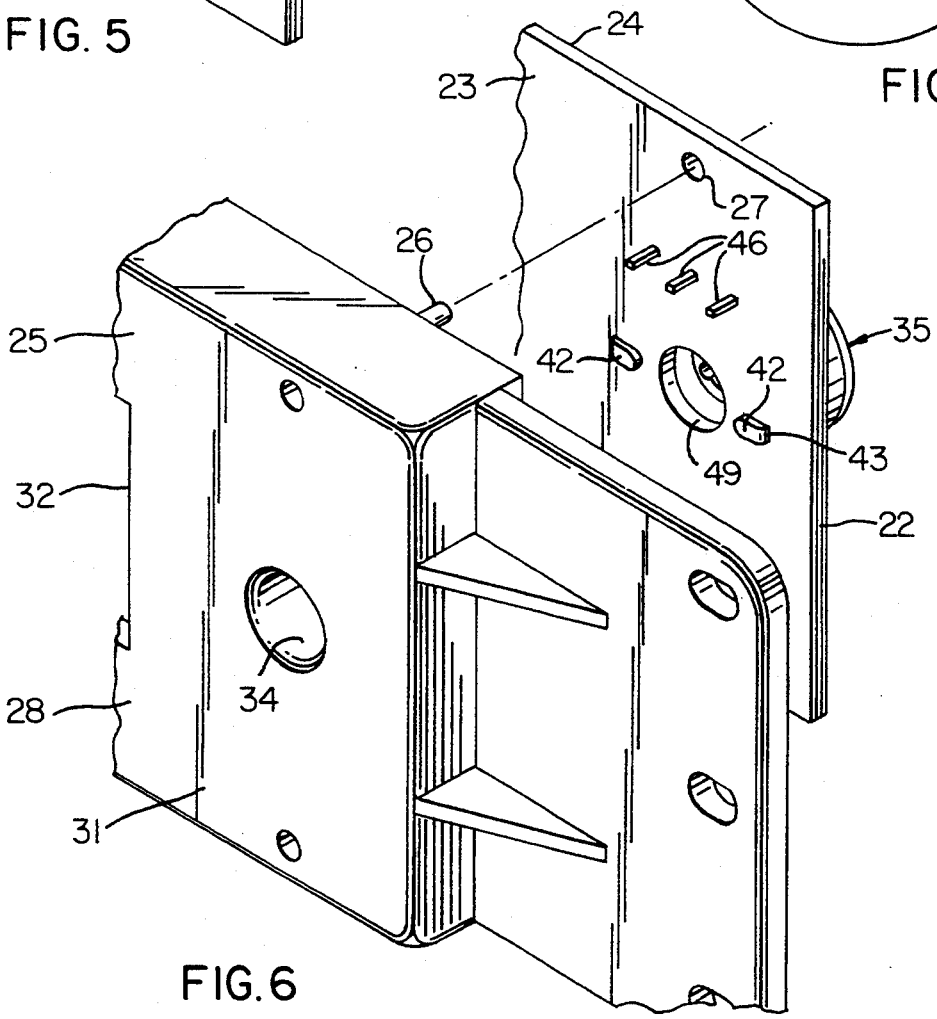
FIG. 6 is an exploded fragmentary perspective view illustrating how the cover means of the control device is to be mounted to the printed circuit board thereof.
Figure 8:
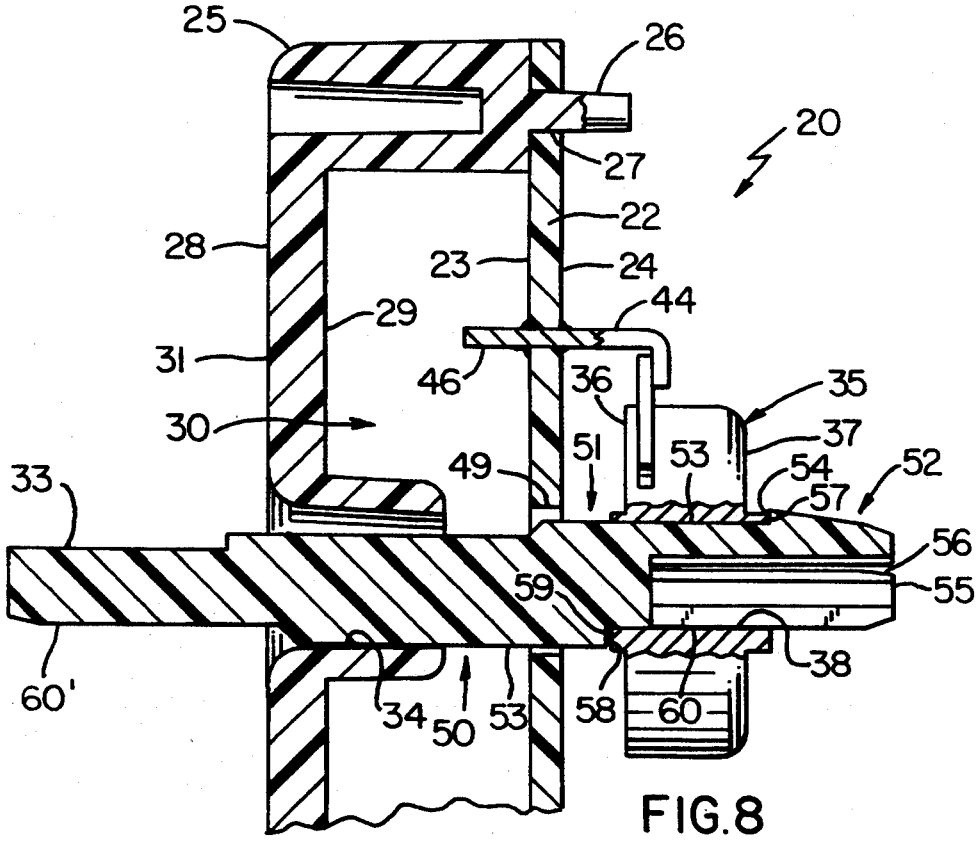
FIG. 8 is an enlarged fragmentary cross-sectional view taken on line 8—8 of FIG. 1.

The rotary switch 35 has a pair of mounting tabs 40 extending from the side 36 thereof with each tab 40 having shoulder means 41 which are adapted to abut against the mounting side 24 of the board 22 when narrow portions 42 of the tabs 40 extend through suitable openings 43 in the board 22 in the manner illustrated in FIG. 5 and are then bent over as illustrated in FIG. 6 to fix the rotary switch means 35 to the board 22 so that the side 36 thereof is mounted in spaced relation to the component mounting side 24 of the board 22 as illustrated in FIG. 8.

The rotary switch 35 also has a plurality of terminals 44 each provided with shoulder means 45 and narrow projecting portions 46 that extend through cooperating openings 47 in the board 45 in the manner illustrated in FIG. 5 so that the projecting portions 46 extend through the printed or solder side 23 of the board 22 to be soldered thereto in a manner well known in the art and thereby interconnect the terminals 44 to the proper printed circuits on the side 23 of the board 22 also in a manner well known in the art.

The rotatable actuator 39 for the rotary switch 35 has three grooves 48 formed in a spaced apart circular array and extending throughout the entire length of the actuator 39 for receiving cooperating splines on the control shaft 33 that will rotate the actuator 39 in unison with rotation of the control shaft 33 as will be apparent hereinafter.

As previously stated, a control shaft is normally inserted into the central opening 38 of the actuator 39 of the rotary switch 35 by being moved from adjacent the component mounting side 24 of the board into the opening 38 in direction toward the component mounting side 24 of the board 22.

However, it was found according to the teachings of this invention that a suitable opening 49 can be formed through the board 22 in alignment with the central opening 38 of the rotary switch 35 as well as in alignment with the opening 34 of the front plate 28 of the closure means 25.

This permits the control shaft 33 of this invention to be inserted through the opening 34 of the closure means 25 and then through the opening 49 in the board 22 to be received in the central opening 38 of the rotary switch 35. Of course, the shaft 33 could be inserted through the opening 49 of the board 22 and then into the opening 38 of the rotary switch 35 before the cover member 25 is disposed in place as the cover member 25 could be telescoped over the control shaft 33 to its final assembled position with the board 22 as desired.

Figure 7:
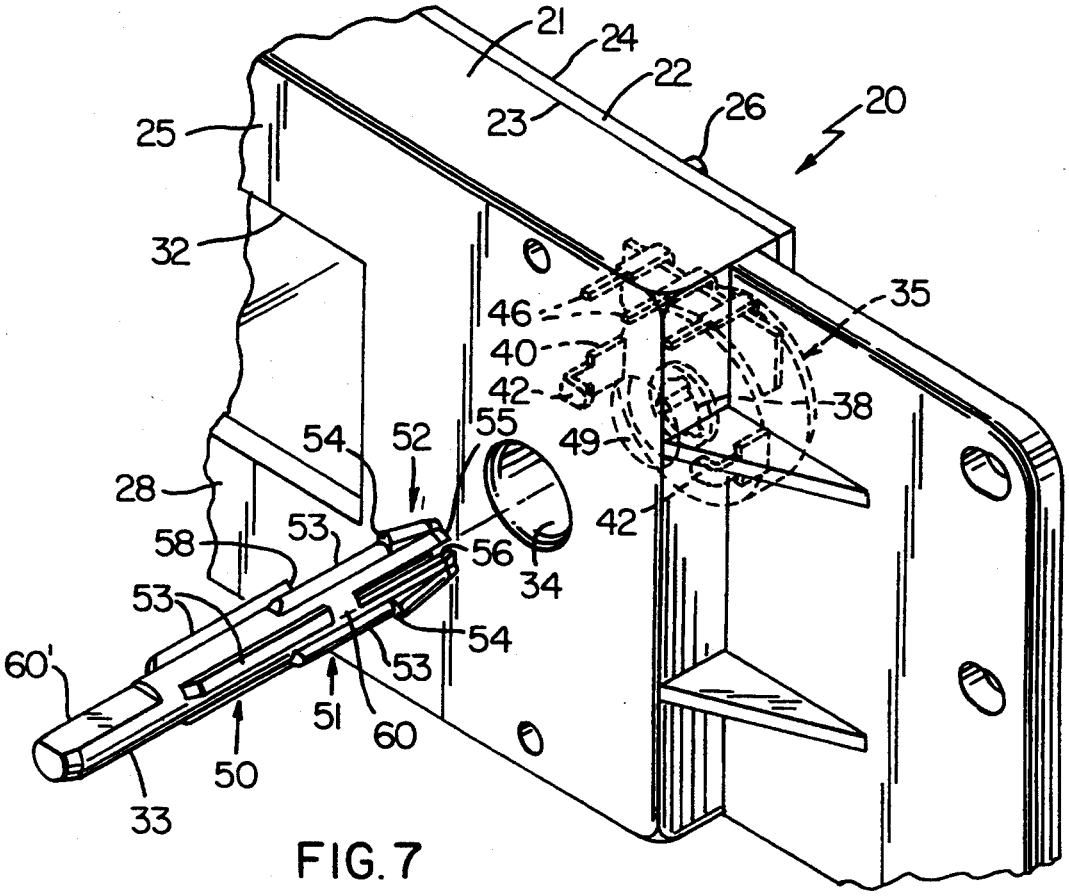
FIG. 7 is an exploded fragmentary view illustrating how the actuator shaft for the rotary switch can be mounted in the control device of this invention.

The control shaft 33 of this invention can be formed of any suitable material such as molded plastic material, and has three sets 50, 51 and 52 of longitudinally diposed ribs 53 each formed in a circular array about the longitudinal axis of the shaft 33, the set 52 of ribs 53 having enlarged ends 54 adjacent the ribs 53 of the set 51 for snap fit purposes and the end 55 of the shaft 33 having slot means 56 formed therein as well as being hollowed to permit the end 55 to be snapped through the opening 38 of the rotary switch 35 when inserted there through from the board 22 to the right as illustrated in FIGS. 7 and 8.

In this manner, the enlarged ends 54 of the ribs 53 of the set 52 engage against the side 57 of the actuator 39 of the rotary switch 35 while free ends 58 of the outer ribs 53 of the set 50 are disposed closely adjacent the other side 59 of the actuator 39 of the rotary switch 35 to completely trap a portion 60 of the shaft 33 within the central opening 38 of the actuator 39 so that subsequent rotation of the shaft 33 causes like rotation of the actuator 39 of the rotary switch 35 to control the setting of the clock time or timer time in the window 32 of the control device 20 for the reasons previously set forth as the set 51 of ribs 53 on the portion 60 of the shaft 33 are received in a apline-like manner in the grooves 48 of the actuator 39 of the rotary switch 35.

Of course, should it be desired to remove the shaft 33 from the control device 20, the end 55 of the shaft 33 can be inwardly compressed so that the ribs 53 of the end set 52 can be retracted through the central opening 38 of the rotary switch 35 as the same is pulled outwardly from the solder side 23 of the board 22 in a reverse direction to the assembly direction previously described.

Therefore, it can be seen that it is a relatively simple method of this invention to form the control device 20 with the rotary switch means 35 being mounted to the component side 24 of the printed circuit board 22 as the control shaft 33 therefor is adapted to be inserted into the central opening 38 of the rotary switch 35 by first being pushed through the opening 49 in the board 22 from the solder side 23 thereof toward the component mounting side 24 thereof and thereby be snap fitted in the opening 38 of the rotary switch 35 through the cooperating sets 50 and 52 of rib means 53 while the intermediate set 51 of rib means 53 are received in the grooves 48 of the actuator 39 to spline the control shaft 33 and actuator 39 together so that the same will rotate in unison upon rotation of the control shaft 33.

Of course, a suitable control knob will be subsequently disposed on the outer end 60' of the control shaft 33 in a manner well known in the art to facilitate rotation of the shaft 33.

Thus, it can be seen that this invention not only provides a new control device, but also this invention provides a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device comprising a printed circuit board having opposed sides one of which comprises a solder side thereof and the other of which comprises a component mounting side thereof, a rotary switch means carried on said component mounting side of said board and comprising a structure having opposed sides with a central opening passing through said opposed sides thereof and with mounting means extending from one of said opposed sides and interconnected with said board so as to space said one of said opposed sides from said component side of said board, said rotary switch means having switch means in said structure, and an actuator shaft having a portion thereof disposed in said central opening for operating said switch means of said rotary switch means upon rotation of said shaft, the improvement wherein said shaft has a means snap fitting said portion thereof in said central opening of said rotary switch means when said portion of said shaft is initially inserted into said central opening by being axially moved from said solder side of said board to said component mounting side of said board, said board having a shaft opening passing through said opposed sides thereof and being in axial alignment with said central opening of said rotary switch means, said shaft having another portion thereof disposed in said shaft opening of said board and having opposed ends one of which extends beyond said solder side of said board and the other of which extends beyond said rotary switch in a direction away from said component mounting side of said board.

2. A control device as set forth in claim 1 wherein said control device comprises a cover member carried by said board and having a front plate disposed in spaced relation to said solder side of said board, said front plate having opposed sides with an opening through said sides thereof in axial alignment with said shaft opening and said central opening and having another portion of said shaft disposed in said opening thereof with said one end of said shaft extending beyond said front plate in a direction away from said solder side of said board.

3. A control device as set forth in claim 1 wherein said shaft has locking parts thereof respectively disposed adjacent said opposed sides of said rotary switch to lock said portion of said shaft in said central opening thereof.

4. A control device as set forth in claim 3 wherein said rotary switch has a rotatable actuator defining said central opening thereof, said portion of said shaft that is disposed in said central opening being splined to said actuator so that rotation of said shaft causes like rotation of said actuator.

5. A control device as set forth in claim 3 wherein said locking parts of said shaft each comprise rib means.

6. A control device as set forth in claim 5 wherein said other end of said shaft is inwardly compressible so as to snap through said central opening when said portion is being initially inserted into said central opening from said solder side of said board to said component mounting side of said board.

7. A control device as set forth in claim 5 wherein said rib means comprise three sets each comprising a plurality of ribs disposed in spaced apart parallel relation on said shaft and being parallel to the longitudinal axis of said shaft.

8. A control device as set forth in claim 7 wherein said sets of rib means are disposed axially along said shaft so that one of said sets is intermediate two of said sets, said two of said sets comprising said locking parts of said shaft.

9. A control device as set forth in claim 2 wherein said intermediate set of ribs is disposed on said portion of said shaft, said rotary switch having a rotatable actuator defining said central opening thereof, said portion of said shaft that is disposed in said central opening having said intermediate set of rib means thereof splined to said actuator so that rotation of said shaft causes like rotation of said actuator.

10. In a method of making a control device comprising a printed circuit board having opposed sides one of which comprises a solder side thereof and the other of which comprises a component mounting side thereof, rotary switch means carried on said component mounting side of said board and comprising a structure having opposed sides with a central opening passing through said opposed sides thereof and with mounting means extending from one of said opposed sides and interconnected with said board so as to space said one of said opposed sides from said component side of said board, said rotary switch means having switch means in said structure, and an actuator shaft having a portion thereof disposed in said central opening for operating said switch means of said rotary switch means upon rotation of said shaft, the improvement comprising the steps of forming said shaft to have means snap fitting said portion thereof in said central opening of said rotary switch means when said portion of said shaft is initially inserted into said central opening by being axially moved from said solder side of said board to said component mounting side of said board, forming said board to have a shaft opening passing through said opposed sides thereof and being in axial alignment with said central opening of said rotary switch means, and forming said shaft to have another portion thereof disposed in said shaft opening of said board and to have opposed ends one of which extends beyond said solder side of said board and the other of which extends beyond said rotary switch in a direction away from said component mounting side of said board.

11. A method of making a control device as set forth in claim 10 and further comprising the steps of forming said control device to comprise a cover member carried by said board and having a front plate disposed in spaced relation to said solder side of said board, and forming said front plate to have opposed sides with an opening through said sides thereof in axial alignment with said shaft opening and said central opening and having another portion of said shaft disposed in said opening thereof with said one end of said shaft extending beyond said front plate in a direction away from said solder side of said board.

12. A method of making a control device as set forth in claim 10 and further comprising the step of forming said shaft to have locking parts thereof respectively disposed adjacent said opposed sides of said rotary switch to lock said portion of said shaft in said central opening thereof.

13. A method of making a control device as set forth in claim 12 and further comprising the steps of forming said rotary switch to have a rotatable actuator defining said central opening thereof, and forming said portion of said shaft that is disposed in said central opening to be splined to said actuator so that rotation of said shaft causes like rotation of said actuator.

14. A method of making a control device as set forth in claim 12 and further comprising the step of forming said locking parts of said shaft to each comprise rib means.

15. A method of making a control device as set forth in claim 14 and further comprising the step of forming said other end of said shaft to be inwardly compressible so as to snap through said central opening when said portion is being initially inserted into said central opening from said solder side of said board to said component mounting side of said board.

16. A method of making a control device as set forth in claim 14 and further comprising the step of forming said rib means to comprise three sets each comprising a plurality of ribs disposed in spaced apart parallel relation on said shaft and being parallel to the longitudinal axis of said shaft.

17. A method of making a control device as set forth in claim 16 and further comprising the steps of forming said sets of rib means to be disposed axially along said shaft so that one of said sets is intermediate two of said sets, and forming said two of said sets to comprise said locking parts of said shaft.

18. A method of making a control device as set forth in claim 17 and further comprising the steps of forming said intermediate set of ribs to be disposed on said portion of said shaft, forming said rotary switch to have a rotatable actuator defining said central opening thereof, and forming said portion of said shaft that is disposed in said central opening to have said intermediate set of rib means thereof splined to said actuator so that rotation of said shaft causes like rotation of said actuator.

* * * * *